US006123739A

United States Patent [19]

Andrews et al.

[11] Patent Number: 6,123,739

[45] **Date of Patent: *Sep. 26, 2000**

[54] METHOD TO IMPART WRINKLE FREE PROPERTIES TO SHEETING AND OTHER FABRICS MADE FROM COTTON

[75] Inventors: George A. Andrews, Auburn; Robert W. Bugg, Jr.; B. Jay Bogan, both of Opelika, all of Ala.

[73] Assignee: Westpoint Stevens Inc., West Point, Ga.

[ * ] Notice: This patent issued on a continued prosecution application filed under 37 CFR 1.53(d), and is subject to the twenty year patent term provisions of 35 U.S.C. 154(a)(2).

[21] Appl. No.: 08/492,266

[22] Filed: Jun. 19, 1995

[51] Int. Cl.[7] ..... D06M 13/322

[52] U.S. Cl. ..... 8/181; 8/182; 8/185; 8/186; 8/115.7

[58] Field of Search ..... 8/185, 186, 115.7, 8/189, 181.182

[56] References Cited

U.S. PATENT DOCUMENTS

| | | | |
|---|---|---|---|
| 3,903,033 | 9/1975 | Chao | 8/185 X |
| 4,028,054 | 6/1977 | North et al. | 8/185 |
| 4,090,844 | 5/1978 | Rowland | 8/120 |
| 4,396,391 | 8/1983 | North | 8/181 |

*Primary Examiner*—Jacqueline V. Howard
*Assistant Examiner*—Cephia D. Toomer
*Attorney, Agent, or Firm*—Pennie & Edmonds LLP

[57] ABSTRACT

A method for imparting wrinkle free properties to cotton or cotton blend fabrics. These wrinkle free properties are achieved through the use of a combination of a DMDHEU based reactant at high levels with a catalyst at a low level.

16 Claims, No Drawings

METHOD TO IMPART WRINKLE FREE PROPERTIES TO SHEETING AND OTHER FABRICS MADE FROM COTTON

FIELD OF THE INVENTION

The present invention relates to improved durable press, all cotton or cotton blend fabrics such as sheeting, that are suitable for producing bedding linens, curtains, table cloths and the like, as well as improved, wrinkle free all cotton or cotton blend apparel and methods for producing such fabrics using low amounts of catalyst and glycolated dimethyloldihydroxyethylene urea.

BACKGROUND OF THE INVENTION

Commercial creaseproofing of cellulosic fabrics began ca. 1926, with the Tootal, Broadhurst, Lee (TBL) method. In the early 1960's, significant advances were developed as taught in U.S. Pat. No. 3,049,446 by using combinations of urea, glyoxal, and formaldehyde to treat fabrics in one step under acidic conditions. This technology was the first to achieve wrinkle resistance with acceptable strength retention and durability. dimethyloldihydroxyethylene urea ("DMDHEU") remains the most widely used creaseproofing agent in the United States, and indeed the world, for cellulosic fabrics today.

However DMDHEU has the disadvantage of high residual parts per million formaldehyde on the fabric after curing. Other advancements in this area were the addition of diethylene glycol to DMDHEU by Andrews et. al., the use of glycolated DMDHEU in U.S. Pat. No. 4,396,391 and the work of Pacifici in U.S. Pat. No. 5,268,502 for reducing formaldehyde in DMDHEU based systems.

DMDHEU, methylated DMDHEU and glycolated DMDHEU all require catalysts to achieve crosslinking in cellulosic fabrics during the curing process. Manufacturers of these creaseproofing chemicals recommend 20–30% catalyst on the weight of the reactant. The combination of the effect of crosslinking, heat and catalyst causes severe strength loss in the cellulosic fabric. This is especially true for all cotton fabrics and cotton blend (50% cotton and above) fabrics.

Recently, apparel fabrics manufacturers of 100% cotton have treated fabric with high levels of creaseproofing agents and have enjoyed favorable consumer acceptance under the description "wrinkle free." While these have achieved market acceptance, the physical performance of the fabrics has been marginal in the area of strength and to some extent the "wrinkle free" properties. There is substantial variation in the wash appearance rating as measured by AATCC Method 124. The term "wrinkle free" has been generally defined as having a DP rating of 3.5 or above when measured by the AATCC Method 124. Many of the apparel fabrics sold as "wrinkle free" 100% cotton actually have DP ratings below 2.5.

There is a need in the art for wrinkle free fabrics that have improved strength over the fabrics currently being manufactured. There is also a need for fabrics which meet the 3.5 wrinkle free standard.

SUMMARY OF THE INVENTION

The present invention is directed to a method of treating cellulosic fibers.

Further, the present invention is directed to a method of manufacturing a wrinkle free all cotton or cotton blend fabric.

Still yet further, the present invention is directed to a process of treating an all cotton or cotton blend fabric using reduced amounts of catalyst in combination with DMDHEU based reactant.

The present invention is further directed to a wrinkle free fabric having improved strength.

The present invention is still yet further directed to a fabric having a balanced strength in both the warp and filling directions.

Also the present invention is directed to a method for imparting wrinkle free properties to cotton fabrics comprising the steps of:

(a) selecting an all cotton or cotton blend fabric construction having filling yarns capable of providing a balanced finished fabric strength in both the warp and filling directions;

(b) contacting the all cotton or cotton blend fabric which has an alkalinity of below 0.2% with a reactant bath comprising a combination of:

(i) an amount of DMDHEU based reactant sufficient to provide a total formaldehyde content to the fabric of from about 0.7% to 1.5%, (ii) a catalyst in an amount of from about 3% to 7% based on the weight of the reactant, (c) processing the cotton or cotton blend fabric under conditions wherein the DMDHEU based reactant is cured to 70% to 95% using at least one heat treatment step.

This invention also relates to a method for producing a wrinkle free cotton or cotton blend fabric having a DP rating of at least 3.5 or above by AATCC Method 124, wherein the strength of the fabric will be about 50% of the strength that the cloth had after bleaching, mercerization or causticization and the formaldehyde release is less than 200 parts per million as measured by AATCC Method 112.

This invention is still further directed to wrinkle free fabrics of from about 3 oz./sq. yd. to about 8 oz./sq. yd. and have strengths appropriate for the construction in both the warp and filling direction. Strengths are lower for the lighter weight fabrics and are higher for the heavier weight fabrics.

DETAILED DESCRIPTION OF THE INVENTION

For purposes of the present invention, the terms all cotton and cotton blend refers to all cotton and cotton blend fabrics that have at least about 20% cotton content by weight.

As used herein, the term "heat treatment step" refers to a change in temperature during the process of curing the reactant onto the cotton or cotton blend fabric.

The term "DMDHEU" based reactant refers to dimethyloldihydroxyethylene urea and its family of related compounds including methylated DMDHEU and glycolated DMDHEU (including polyethylene glycol reacted with DMDHEU).

Dimensional change refers to changes in length or width of a fabric specimen subjected to specified conditions. The change is usually expressed as a percentage of the initial dimension of the specimen.

In the present invention the term growth means a dimensional change resulting in an increase of length or width of a specimen.

Laundering of textile materials refers to a process intended to remove soils and/or stains by treatment (washing) with an aqueous detergent solution and normally including rinsing, extraction and drying.

The term shrinkage is defined to be a dimensional change resulting in a decrease in the length or width of a specimen.

Cotton count of a yarn refers to the yarn numbering system based on length and weight originally used for cotton yarns and now employed for most staple yarns spun on the cotton, or short-staple, system. It is based on a unit length of 840 yards, and the count of the yarn is equal to the number of 840-yard skeins required to weigh 1 pound. Under this system, the higher the number, the finer the yarn.

Wrinkle resistance is that property of a fabric which enables it to resist the formation of wrinkles when subjected to a folding deformation. Wrinkle resistance in a fabric is a desirable attribute, but it is not easily measured quantitatively. Wrinkle resistance varies from quite low in many fabrics to very high in resilient fabrics. In order to form a wrinkle, a fabric's wrinkle resistance must be overcome. The fabric may, however, produce strains and store potential energy that can become evident as wrinkle recovery under suitable conditions.

In accordance with the present invention, we have found methods for producing "wrinkle free" (DP rating=3.5 or above by AATCC Method 124), woven fabrics of either 100% cotton or cotton blend (50% cotton or higher blended with polyester, for example) in which the strength remains high and the parts per million free formaldehyde released remain low.

The present invention is directed to cotton and cotton blend wrinkle free fabrics and methods of making such wrinkle free fabrics. The methods of this invention may be viewed in at least three parts. The combination of parts which make up the present process are (1) yarn and fabric construction, (2) chemical treatment and (3) processing conditions.

Any yarn or fabric incorporating some amount of cotton may be used in the present invention. It is preferred that the amount of cotton in the fabric to be treated is in an amount above about 40%. It is more preferred that cotton be present in an amount greater than about 65%. Even more preferred is fabric which incorporates cotton in an amount greater than 80%. All cotton fabrics, using 100% cotton, are most preferred for use in the present invention.

The cotton or cotton blend fabric can be any type of fabric including, for example, woven, non-woven, felt or knit fabrics. Woven fabrics are preferred. For woven fabrics, patterns such as plain, fancy, oxford, twill or sateen may be used, to mention but a few.

Any yarn having a cotton count fulfilling the parameters of the present invention may be used. In particular warp yams range in cotton count 32's through 65's and filling yarns 30's through 65's.

In order for this invention to produce satisfactory and/or optimal results the yarn strength and weaving construction must be approximately balanced so that warp and filling fabric strengths will be similar after finishing. It is preferred that for whatever yarns are used for the warp and filling of the present invention, that the yarns in the cotton or cotton blend fabric of the claimed invention produce a fabric having similar strength in the warp and filling directions once they have undergone the process of the present invention. It is preferred that the final strength of the fabric be above the minimum specified for a given final fabric and that the final strength in the warp and filling directions be within 50% of each other. It is more preferred that the final strength in the warp and filling directions be within 25% of each other and over the final strength set for a particular cloth. It is most preferred that the final strength in the warp and filling directions be within 15% of the strength of each other.

Warp threads per inch may range from 80 through 200 and fillings threads 72 through 135. Fabric counts may be T-160 through T-300 and the weights of the fabrics can range from 3 oz./sq. yd. to 8 oz./sq. yd.

Depending on the weight of the cotton or cotton blend fabric to be used according to the process of the present invention the final strength of different fabrics, similarly treated can have widely varying properties.

The fabric used can be any weight cotton or cotton blend fabric used to produce common consumer cotton goods such as bed sheets and linen type goods, for example. It is preferred that the weight of the fabric be from about 3 ounces per square yard to about 8 ounces per square yard. While cotton and cotton blend fabrics below 3 oz/sq. yd. or above 8 oz/sq.yd may be used in the process of the claimed invention, such low weight fabrics will have low final strength and high weight fabrics are commonly used in industrial applications. The more preferred range of fabric weights is from about 4 oz/sq. yd. to about 6 oz/sq.yd.

The first step in the present invention can be to subject cotton cloth to an initial cleaning and/or preparatory step that will remove the motes from the cotton. Motes are that debris, such as pieces of seed or stalk, that remain in the cotton after it is processed. This initial step includes for example bleaching, caustic treatment or mercerizing.

Bleaching can be used to make the cotton white, and remove motes. Caustic treatment, is the treatment of the cotton fibers with a solution of approximately 17% caustic soda which also removes motes. Mercerizing is the treatment of cotton fibers with 22% or greater solution of caustic soda at cold temperature to remove motes and make the cotton fibers swell and become fluffy. Fabrics according to the present invention can be bleached, mercerized or causticized by commercial methods well known to the skilled artisan.

After this initial preparation, rinsing must take place to reduce the fabric alkalinity to below about 0.2% according to the method described in Example 1 below. If the alkalinity is more than about 0.25% the process according to the present invention would not work. It is preferred that the alkalinity be adjusted to from about 0.03% to 0.12%. Most preferred is an adjustment to an alkalinity to a range of from about 0.03% to about 0.07%. These low levels are necessary because higher levels interfere with the chemical treatment and the resultant DP rating.

Fabrics may also be dyed by any known commercial methods with any dye class suitable for cotton and that is considered acceptable for reactant finishing. In the case of cotton blend fabrics the polyester portion may also be dyed with disperse dyes by the Thermosol Process or other methods. Rinsing after dyeing must take place so that the fabric alkalinity is 0.2% or below preferably 0.03 through 0.12%.

Fabrics may also be pigment dyed from the same bath that contains the "wrinkle free" chemical treatment. However, the alkalinity of whatever fabric is brought to the "wrinkle free" treatment is adjusted to below 0.12% and preferably between 0.03% to 0.012. It is believed that residual alkalinity in the fabric can neutralize and block the effect of the catalyst and interfere with crosslinking.

The "wrinkle free" chemical treatment can be based on DMDHEU (1,3-dihydroxymethyl-4,5-dihydroxy-2-imidazolidinone), Methylated DMDHEU or Glycolated DMDHEU. We prefer in order Glycolated DMDHEU, DMDHEU then Methylated DMDHEU. The DMDHEU based reactant can be the reaction product of diethylene glycol with 1,3-dihydroxymethyl-4,5-dihydroxy-2-imidazolidinone in a molar ratio of 0.5 through 2.0 of diethylene glycol to one mole of 1,3-dihydroxymethyl-4,5-dihydroxy-2-imidazolidinone. The DMDHEU based reactant can also be the reaction product of methanol with 1,3-dihydroxymethyl-4,5-dihydroxy-2-imidazolidinone in a molar ratio of 0.5 through 4 of methanol to one mole of 1,3-dihydroxymethly-4,5-dihydroxy-2-imidazolidinone. The reactant may be 1,3-dihydroxymethyl-4,5-dihydroxy-2-imidazolidinone. As stated above, a glycolated DMDHEU based reactant, such as the reaction product of polyethylene glycol of molecular weight 200 through 600 in a molar ratio of 0.5 through 2 to one mole of 1,3-dihydroxymethyl-4,5-dihydroxy-2-imidazolidinone may also be used.

The cotton or cotton blend fabric can be treated using any method of applying reactant to the fabric such as passing the fabric through a bath, padding the treatment onto the fabric, etc. It is preferred that the fabric be treated by passing the fabric through a bath of from 8% to 16% by weight of bath of active reactant. The wet pickup of the fabric should be from about 20% to about 80% or preferably from about 30% to about 60%. This is typically accomplished by applying the reactant from a pad bath with a pad pressure of from about 20 psi to about 80 psi or more preferably from about 45 psi to about 65 psi and passing the fabric over a vacuum slot with a vacuum setting of from about 5 inches through 20 or more preferably 15 inches of Mercury. As stated above any method known to the person of ordinary skill in the art may be used to apply the DMDHEU reactant to the cotton or cotton blend fabric in such a manner to impart to the fabric a total formaldehyde content of 0.7% through 1.5% as measured according to example 1.

The DMDHEU based reactant may have the pH adjusted using any of the compounds selected from the group consisting of acids such as fluoboric, acetic, glycolic, malic, lactic, citric, tartaric and oxalic.

Further, a catalyst can be used in combination with the DMDHEU based catalyst. The catalyst can be any catalyst that will accomplish the goals of the present invention, one of which is to effect the crosslinking of the DMDHEU reactant. In particular, any of the catalysts selected from among the chlorides and nitrates of the group IIA metals including magnesium, calcium, strontium and barium may be used. The more preferred catalysts are magnesium chloride, zinc chloride, zinc fluoborate, magnesium fluoborate, calcium nitrate, zinc nitrate, zirconium oxychloride, sodium or potassium bisulfate; amine hydrochlorides such as the hydrochloride of 2-amino-2-methyl-1-propanol, and the like and mixtures thereof. The most preferred catalyst is $MgCl_2.6H_2O$ which is for example available as Griffcat 739, acidified catalyst containing 33% $MgCl_2$ $6H_2O$, from Grifftex® Chemicals.

The amount of catalyst used in combination with the DMDHEU based reactant, can be any amount that is effective for use in the present invention. The amount will vary depending on the chemical nature of the catalyst selected. The preferred amount of $MgCl_2.6H_2O$, as the catalyst, is from about 1.0% to about 15% active catalyst on the active weight of the DMDHEU based reactant. More preferable is an amount of from about 3% to about 12% on the weight of the reactant. Still more preferable is an amount of $MgCl_2.6H_2O$ of from about 4% to about 10% on the active weight of the DMDHEU based reactant. The most preferable amount is from about 5% to about 7% on the weight of the reactant. Catalysts other than $MgCl_2.6H_2O$ may require more or less amounts of catalyst depending on the catalytic activity of the catalyst chosen. It is this uniquely low level of catalyst that allows crosslinking with cotton of the DMDHEU based reactant applied at high levels to the fabric with minimal damage to the strength. It is believed that the fabric becomes saturated with catalyst at about these levels and that higher amounts deteriorate the cotton strength.

A preferred combination of DMDHEU reactant and catalyst is available under the name Griffrez 1485 which is a pre catalyzed 50% glycolated DMDHEU reactant containing 2.6% $MgCl_2.6H_2O$.

Cures are typically 80% through 95% with these low levels of catalyst. These represent normal cures for DMDHEU based reactants. However, fabric formaldehyde parts per million are very high unless a formaldehyde scavenger or acceptor is used. Formaldehyde scavengers and their use has been described in U.S. Pat. Nos. 5,268,502, 5,112,652, 5,160,503, and 5,352,372, said patents being herein incorporated by reference in its relevant parts. The preferred formaldehyde scavengers are available from Grifftex® Chemicals as Griffenger WPS, 100% active formaldehyde scavenger and Griffenger 1431 100% active formaldehyde scavenger.

The combination of a DMDHEU based reactant at high levels with a catalyst at low levels and the use of a formaldehyde scavenger to reduce fabric formaldehyde parts per million to under 200 is part of the "wrinkle free" element of this invention. The remaining part is the use in the treatment of an oxidized high density polyethylene emulsion either nonionic or preferably cationic to improve the hand of the treatment and to reduce further the loss of strength from the treatment with catalyst and DMDHEU based reactant. These emulsions are available as Griffsoft 1483, which is cationic high density polyethylene emulsion 22% active, and Griffsoft HDP-25 nonionic high density polyethylene emulsion 25% active. Other softeners such as silicone based, cationic or nonionic fatty based are not preferred because they can deteriorate strength or reduce DP ratings.

The entire chemical treatment performs best if it is applied with a wetting agent used to promote pickup and uniformity Any wetting agent which will ease or accomplish the goals of the present invention may be used in the present invention. A preferred wetting agent is available under the name Griffwet 484, 100% active nonionic wetting agent, from Grifftex® Chemicals. However this is not necessarily a component of the "wrinkle free" chemical treatment if the total formaldehyde content is from 0.7% through 1.5% on the weight of the fabric.

The pH of the "wrinkle free" chemical treatment bath is adjusted to 3 to 6 preferably 3 to 4 for dyed fabrics and 3.5 to 4.5 for fabrics which are to be colored with pigments. Acids used for the adjustment may be citric, malic, hydrochloric, hydroxy acetic or others.

Other finishing chemicals such as antimigrants, including Griffmigrant 1466, 38% active nonionic antimigrant or pigment binders, such as for example, Polycryl 7F12-commercial acrylic pigment binder manufactured by Morton Thiocol, may be used selectively. There is substantial variation in hand and wash appearance from one commercial product to another.

After the fabric has been impregnated with the "wrinkle free" treatment chemicals it may be cured by either a two pass method or a one pass method.

In the two pass method the fabric is dried in an oven at about 250° F. at approximately 100 yards per minute. The fabric is rolled or collected in a J-Box and then passed through another dryer, set at about 400° F., at about 100 yards per minute so that the fabric exit temperature is 365° F.–385° F. depending on whether the fabric has been dyed already or is being colored with pigments in the "wrinkle free" chemical treatment. If the fabric is dyed the exit temperature is 375° F.–385° F. If it is to be colored with pigments then the exit temperature should be 365° F.–375° F. This method offers the advantage that older commercial dryer equipment with fewer controls can produce satisfactory results. However, in handling the fabric two or more times there is opportunity for variation if the temperatures and speeds of the ovens are not carefully maintained.

The one pass method specifies that the treated fabric have relatively low moisture content, generally under 50% and preferably 35%–40%. The fabric can be passed through an infrared predryer and then into an oven with up to five heating zones and preferably up to nine heating zones. The zones can be set so that the fabric is first dried, the temperature raised and then cured. The fabric exit temperature can be as above depending on whether dyed or colored with pigments. The zones can be for example, set to incremental increases in temperature. For example, a nine zone range can be: Zone 1=360° F., Zone 2=380° F., Zone 3=380° F., Zone 4=390° F., Zone 5=390° F., Zone 6=400° F., Zone 7=400° F., Zone 8=410° F. and Zone 9=410° F. The fabric exit temperature can be controlled by the speed of the cloth which may be from about 80 to 110 yards per minute. The fabric may be then cooled by cooling cans and rolled for later fabrication into sheets, pillow cases, garments or other finished products.

The cloth can have a DP rating of 3.5 or higher and the strength can be approximately 50% of the strength that the cloth had after peroxide bleaching, mercerization or causticization. The formaldehyde parts per million will be below 200.

EXAMPLES

The following examples illustrate compositions and methods according to the present invention. The scope of the present invention is not intended to be limited in any way by the following examples. All parts are by weight unless otherwise indicated.

Example I

TEST PROCEDURE FOR DETERMINATION OF TOTAL/BOUND FORMALDEHYDE ON TEXTILE FABRICS

Cut a 4×4 Specimen from the center of the fabric to be tested. Separate the fabric into 2 pieces: one for total formaldehyde and one for bound formaldehyde. Prepare numbered jar, two for each sample (one total, one bound) and label them 1-T 1-B 2-T 2-B, etc. For the total formaldehyde determination, cut exactly 0.5 grams and place it in the pre-labeled jar "T". For the bound formaldehyde determination, scour all the premarked specimens together for 1 hour at a boil in 2% $Na_2CO_3$ (soda ash). Then tumble dry the scoured fabrics and weigh out exactly 0.5 grams of each and place in pre-labeled jar "B". Into each jar (both T nd B), add 100 ml. 12N sulfuric acid (3000 ml. $H_2O$/1,550 ml. 96% $H_2SO_4$). Let these jars sit, uncovered, for approximately 18 hours.

Make up a 10% chromatropic acid solution (example: 5 grams of acid to 45 grams of water). Label clean 100 ml. volumetric flasks in the manner as indicated for the sample jars above. Pipette 2 ml of chromatropic acid into each flask. Then pipette 2 ml. of the solution in the jars to the corresponding flask. Add 10 ml. 96% Sulfuric acid to each flask. If color is not dark enough to get a reading on the spec 20, use a 50 ml. flask and repeat steps 2–5.

Make up blanks using 2 ml. chromatropic acid solution and 10 ml. concentrated sulfuric acid. If both 100 and 50 ml. flasks are used, make a blank for each. Place all prepared flasks in a hot water bath and boil for 30 minutes. (including blanks). Remove the flasks from the hot water bath and cool. Then dilute with distilled water to mark. Let the sample come to room temperature and add distilled water to the mark, if needed. Then place specimen in microcell as they are run. Use the same cell for each, washing between with the next sample. Set Spectronic 20, Spectronic 20 colorimeter/Spectro photometer, wave length control on 570. Zero the meter with zero control knob. Insert microcell with the blank into the spec 20 and use light control knob to set the meter on 100 (100% transmittance). Put each specimen in the microcell and record the transmittance reading for each. (NOTE: if the reading falls below 30, go to a larger than 100 ml. volumetric flask. If the reading is above 80, go to a smaller than 100 ml. flask and repeat the procedure starting with the preparation of a 10% chromatropic acid solution.

To calculate the % formaldehyde record the transmittance reading of each sample. Then find PPM formaldehyde by reading from a calibration curve on the chromatropic acid lot used. Use the following formulae to determine the % formaldehyde and % cure:

$$\%\ \text{Formaldehyde} = \frac{0.25 \times \text{chart reading for 50 ml. flask}}{0.50} = \frac{0.50 \times \text{chart reading for 100 ml. flask}}{0.50}$$

$$\%\ \text{Cure} = \frac{\%\ \text{Bound Formaldehyde}}{\%\ \text{Total Formaldehyde}} \times 100$$

Example II

FABRIC ALKALINITY

This procedure determines the alkalinity contained in the fabric. Obtain a fabric sample by tearing a 1 inch strip of cloth from selvage to selvage across the width of the fabric. Weigh the fabric sample. Obtain a 10 gram sample of cloth and cut it into small pieces into a beaker. (If the sample weighs more than 10 grams, cut fabric away from the middle of the fabric. If the sample weighs less than 10 grams, add fabric from the middle of the remaining fabric from which the strip was obtained). Add 400 grams of distilled water. Add 10 ml of 0.1N hydrochloric acid "(HCL)" from a volumetric pipette. Put a mark on the beaker at water level. Boil for 2 minutes. Allow the beaker and contents to cool. Add water to mark on beaker. Remove the cloth and squeeze the liquid back into the beaker. Titrate with 0.1N sodium hydroxide (NaOH) to a ph of 4.5.

The percentage alkalinity can be calculated using the following formulae:

$$\%\ \text{ALKALINITY} = [(\text{ML HCL} \times \text{N HCL}) - (\text{ML NaOH} \times \text{N NaOH})][0.4]$$

or $$\%\ \text{ALKALINITY} = 1 - (___\text{ML NaOH} \times 0.1) \times 0.4$$

Example 3

This test method is intended for the determination of dimensional changes in woven and knit fabrics when subjected to repeated automatic laundering procedures commonly used in the home. Four washing temperatures ranging from cold to hot are intended to reflect the usual range of cold, warm and hot temperatures in home washing. Three agitation cycles in laundering reflect those which are commonly available to the consumer. Four drying test procedures cover the range of drying techniques used in the home. Three specimens of each sample to be tested are required to increase the precision of the average. Where possible, each specimen should contain different groups of length-wise and widthwise yarns.

Fabrics that are distorted in their unlaundered state due to faulty finishing may give deceptive dimensional change results when laundered by any procedure. In such cases, it is recommended that specimens not be taken or, if used, the results considered as indicative only. Prior to marking, pre-condition and then condition test specimens as directed in ASTM D 1776, Conditioning Textiles for Testing. Condition each specimen for at least 4 hours in an atmosphere of 21±1C (70+2F) and 65±2% RH by laying each test specimen separately on a screen or perforated shelf of a conditioning rack.

Woven and warp knit fabrics; take each 38×28 cm (15×15 in.) test specimen and mark with three 25 cm (10 in.) pairs of bench marks parallel to the width of the fabric. Each bench mark must be at least 5.0 cm (2 in.) from all edges of the test specimen. Pairs of bench marks in the same direction must be approximately 12 cm (5 in.) apart. Any alternate size specimens and bench marks used must be indicated in report. Marks of 50 cm or 18 in. are commonly used to give better measurement precision (see 12.7). Sewing thread can be used to make bench marks.

Flat and circular knit fabrics; tubular finished knit fabric samples representing goods used in the tubular state; i.e., underwear, sweat shirts, polo shirts, etc.; are to be tested in the tubular state. Tubular finished knit fabric samples representing goods used in the slit open width state; i.e., dresses, slacks, suits, etc. are to be slit and handled flat. Mark specimens as indicated above. For narrow fabrics (woven, knit or tubular) less then 38 cm (15 in.) wide; take full width of test fabrics and cut each specimen 38 cm (15 in.) long. Mark the length as indicated above. Test specimens which are 2.5–12.5 cm (1–5 in.) wide, use only two pairs of bench marks parallel to the length; test specimens less than 2.5 cm (1 in.) in width need only one pair of bench marks parallel to the length, and measurement of the width is optional. To improve the accuracy and precision of the dimensional change calculations based on the bench marks applied to the fabrics as above, measure and record the distance between each pair of bench marks with suitable tape or rule to nearest millimeter, tenth of an inch or smaller increment. This is measurement A. In case of narrow fabrics less than 38 cm (15 in.) wide, measure and record width.

Tables I, II and III summarize alternative washing and drying conditions and settings. Additional information on the machine and laundering conditions may be found in the AATCC Test Method Manual, herein incorporated by reference in its entirety.

Use specified water level, the selected water temperature for the washing cycle and a rinse temperature of less than 29C (85F). If this rinse temperature is not attainable, record available rinse temperature. Add 90 g of AATCC Standard Reference Detergent 124. In soft water areas the weight may be reduced to avoid excessive sudsing.

Add test specimens and enough ballast to make a 1.8+0.1 kg (4.00+0.25 lb) load. A 3.6±0.1 kg (8.00±0.25 lb) load can be used (see 12.8). Set the washer for the selected washing cycle and time (see Tables I and II).

For specimens to be dried by procedures A, B or D, allow washing to proceed automatically through the final spin cycle. Remove the test specimens immediately after the final spin cycle, separate tangled pieces, taking care to minimize distortion, and dry by procedure A, B or D (See Tables I and III). For specimens to be dried by procedure C, Drip Dry, remove the specimens from the washer just before the water begins to drain for the final rinse cycle. Remove specimens soaking wet.

Tumble Dry. Place the washed load (test specimens and ballast) in the tumble dryer, and set the temperature control to generate the correct exhaust temperatures as specified in Table III. For fibers that are heat sensitive, lower temperatures consistent with producer's recommendations are required and must be reported. Operate the dryer until the total load is dry. Remove the load immediately after the machine stops.

Line Dry. Hang each specimen by two corners with the fabric length in the vertical direction. Allow the test specimen to hang in still air at room temperature until dry.

Drip Dry. Hang each dripping wet specimen by two corners, with the fabric length in the vertical direction. Allow the specimens to hang in still air at room temperature until dry.

Screen Dry. Spread each specimen on a horizontal screen or perforated surface removing wrinkles but not distorting or stretching it. Allow the specimen to dry in still air at room temperature.

Repeat the selected washing and drying cycle four more times or to an agreed number of cycles.

After the completed washing and drying interval, pre-condition and condition the specimens for at least 4 hours by laying each specimen separately on the screen or perforated shelf of a conditioning rack in an atmosphere of 21±1C (70±2F) and 65±2% RH.

If the specimens are wrinkled and the appearance is such that the consumer would expect to iron the garment made from the sample material, or if knit fabrics would be stretched as a garment which donned or the sample material would be tension pressed, follow the appropriate, instructions in AATCC. Method 160, Dimensional Restoration of Knitted and Woven Fabrics After Laundering.

After conditioning lay each test specimen without tension on a flat smooth, horizontal surface. Measure and record the distance between each pair of bench marks to the nearest millimeter, tenth of an inch or smaller increment. This is measurement B. If using a scale calibrated in per cent dimensional change, measure to nearest 0.5% or smaller increment and record the per cent dimensional change directly.

The wrinkles in most fabrics flatten sufficiently under pressure of a measuring instrument at the time of measurement not to cause measurement bias.

Calculation

If measurements were made directly in per cent dimensional change, average the measurement in each direction made on the three specimens after the first and, if completed, the fifth or other specified number of washing and drying cycles. Calculate length and width averages separately to the nearest 0.1%.

If measurements were made to the nearest millimeter or 0.1 inch or smaller, calculate the dimensional change after the first and, if completed, the fifth or other specified washing and drying cycles as follows:

$$\% DC = 10(B - A)/A$$

Where $DC$ = Dimensional change $A$ = Original dimension $B$ = Dimension after laudering Both original and final dimensions are the averages of the measurements in each direction made on the three test specimens. Calculate length and width averages separately to nearest 0.1% (see 12.9).

A final measurement smaller than the original measurement results in a negative dimensional change which is shrinkage. A final measurement larger than the original measurement larger than the original measurement results in a positive dimensional change which is growth or negative shrinkage.

TABLE I

Alternative Washing and Drying Conditions (see 7.1)

| Machine Cycle | Washing Temperature | Drying Procedure |
|---|---|---|
| (1) Normal/Cotton Sturdy<br>(2) Delicate<br>(3) Permanent Press | (II) 27 ± 3C (80 ± 5F)<br>(III) 41 ± 3C (105 ± 5F)<br>(IV) 49 ± 3C (120 ± 5F)<br>(V) 60 ± 3C (140 ± 5F) | (A) Tumble<br>i Cotton Sturdy<br>ii Delicate<br>iii Permanent Press<br>(B) Line<br>(C) Drip<br>(D) Screen |

TABLE II

Washing Machine Conditions Without Load (see 7.1)

| Machine Cycle | Normal | Delicate | Permanent Press |
|---|---|---|---|
| (A) Water Level | 18 ± 1 gal | 18 ± 1 gal | 18 ± 1 gal |
| (B) Agitator Speed | 68 ± 2 spm | 45 ± 2 spm | 68 ± 2 spm |
| (C) Washing Time | 12 min | 8 min | 10 min |
| (D) Spin Speed | 510 ± 15 rpm | 340 ± 15 rpm | 340 ± 15 rpm |
| (B) Final Spin Time | 6 min | 4 min | 4 min |

TABLE III

Dryer Setting Conditions (see 7.1)

| Machine Cycle | Cotton Sturdy | Delicate | Permanent Press |
|---|---|---|---|
| Exhaust Temperature | High<br>66 ± 5C (150 ± 10F) | Low<br><60C (140F) | High<br>66 ± 5C (150 ± 10F) |
| Cool Down Time | 5 min | 5 min | 10 min |

The following tables set forth results indicting the utility of the present invention to provide improved wrinkle resistance to all cotton or cotton blend fabrics. The tensile strength described in column 3 is the breaking and elongation by the strip method according to ASTM D 1682-64. Shrinkage as described in column 4 of the following table was determined by AATCC Test Method 135-1992 which is herein described as example 3. Durable press properties are shown in column 5 and were determined using AATCC method 124. The total, bound and cure amounts of formaldehyde in the tested fabric, appearing in columns 6, 7 and 8 respectively were performed according to example 1, above. Odor was determined using AATCC test method 112-1993. The publications entitled "AATCC Technical Manual" published by the American Association Of Textile Chemists And Colorists contains the detailed methodology of each of the test procedures described herein. All patents, patent applications and printed publications mentioned herein are specifically incorporated by reference (in their entirety).

WINKLE FREE PHYSICAL RESULTS

| SAMPLE IDENTIFICATION | TENSILE | SHRINKAGE | DURABLE PRESS | TOTAL | BOUND | CURE | ODOR |
|---|---|---|---|---|---|---|---|
| ADOBE | | | | | | | |
| B46238 | 42 × 39 | −1.1 × 0.5 | 3.50 | 1.18 | 1.14 | 89 | 195 |
| B46239 | 43 × 41 | −1.0 × −0.4 | 3.67 | 1.28 | 1.20 | 93 | 170 |
| B42386 | 46 × 44 | −2.1 × −0.3 | 3.50 | 1.00 | 0.90 | 90 | 55 |
| B42387 | 49 × 47 | −2.7 × −0.7 | 3.50 | 1.15 | 1.03 | 89 | 215 |
| B42383 | 37 × 38 | −1.9 × −1.4 | 3.75 | 0.92 | 0.85 | 92 | 171 |
| BUTTERCUP | | | | | | | |
| B45287 | 35 × 41 | −0.9 × −.06 | 3.50 | 1.53 | 1.48 | 96 | 175 |
| B45289 | 38 × 36 | −1.6 × 0.2 | 3.50 | 1.24 | 1.12 | 90 | 110 |
| B45291 | 42 × 41 | −1.5 × 0.2 | 3.50 | 1.15 | 1.00 | 87 | 165 |
| B45288 | 42 × 43 | −1.5 × −1.0 | 3.67 | 1.36 | 1.32 | 97 | 165 |
| B42476 | 40 × 51 | −2.0 × −0.5 | 3.50 | 1.36 | 1.12 | 82 | 135 |
| CELERY | | | | | | | |
| B42398 | 46 × 47 | −1.5 × −0.5 | 3.50 | 0.95 | 0.88 | 92 | 65 |
| B42396 | 40 × 40 | −1.9 × −1.3 | 3.50 | 0.92 | 0.88 | 96 | 25 |
| B42393 | 41 × 47 | −1.6 × −1.4 | 3.50 | 1.18 | 1.03 | 81 | 130 |

-continued

WINKLE FREE PHYSICAL RESULTS

| | | | | | | | |
|---|---|---|---|---|---|---|---|
| COOL WHITE | | | | | | | |
| B43393 | 44 × 35 | −1.4 × −0.4 | 3.50 | 1.00 | 0.85 | 85 | 245 |
| B43392 | 44 × 37 | −1.3 × −0.6 | 3.50 | 1.25 | 1.15 | 90 | 320 |
| B42035 | 45 × 39 | −1.7 × −1.2 | 3.67 | 0.92 | 0.83 | 90 | 60 |
| B42035 | 39 × 35 | −1.6 × −0.9 | 3.67 | 1.09 | 1.03 | 94 | 55 |
| B42034 | 43 × 35 | −1.6 × −0.7 | 4.00 | 0.98 | 0.90 | 92 | 75 |
| CRANBERRY | | | | | | | |
| B46603 | 48 × 39 | −1.9 × 0.1 | 3.50 | 0.91 | 0.91 | 100 | 105 |
| B46609 | 49 × 44 | −1.4 × −0.7 | 3.67 | 1.08 | 1.04 | 96 | 101 |
| B46606 | 47 × 42 | −1.2 × 0.3 | 3.67 | 0.60 | 0.55 | 91 | 80 |
| B46609 | 44 × 46 | −1.8 × −0.6 | 3.83 | 0.86 | 0.79 | 92 | 105 |
| B46606 | 47 × 42 | −1.3 × −0.5 | 4.00 | 0.91 | 0.88 | 97 | 85 |
| EVERGREEN | | | | | | | |
| B45659 | 47 × 51 | −1.3 × −0.2 | 3.50 | 1.40 | 0.62 | 44 | 150 |
| B45658 | 54 × 54 | −1.8 × −1.0 | 3.67 | 1.25 | 1.03 | 82 | 155 |
| B46256 | 49 × 44 | −2.2 × −1.1 | 3.67 | 0.99 | 0.86 | 87 | 150 |
| B44469 | 46 × 47 | −1.4 × −0.6 | 3.50 | 1.09 | 0.92 | 84 | 175 |
| B43144 | 48 × 45 | −1.3 × −0.4 | 3.50 | 0.95 | 0.81 | 85 | 140 |
| INDIGO | | | | | | | |
| B42739 | 36 × 45 | −1.4 × 0.1 | 3.50 | 0.95 | 0.85 | 89 | 140 |
| B42738 | 39 × 36 | −1.2 × −0.1 | 3.67 | 0.98 | 0.95 | 97 | 90 |
| B44355 | 35 × 39 | −1.2 × −0.4 | 3.67 | 0.98 | 0.88 | 90 | 110 |
| B42739 | 35 × 37 | −1.4 × 0.2 | 3.67 | 0.95 | 0.81 | 85 | 105 |
| B42740 | 38 × 39 | −1.1 × −0.3 | 3.75 | 0.95 | 0.83 | 87 | 135 |
| IVORY | | | | | | | |
| B42132 | 42 × 53 | −1.2 × 0.5 | 3.50 | 1.06 | 0.83 | 78 | 295 |
| B42132 | 45 × 45 | −0.9 × −0.5 | 3.50 | 1.00 | 0.88 | 88 | 280 |
| B43803 | 39 × 37 | −1.1 × −0.3 | 3.50 | 1.24 | 0.90 | 73 | 185 |
| B42133 | 37 × 37 | −1.2 × −0.3 | 3.50 | 1.09 | 1.00 | 92 | 185 |
| B45265 | 50 × 49 | −.09 × −0.4 | 3.50 | 1.18 | 1.03 | 87 | 155 |
| MISTY BLUE | | | | | | | |
| B44483 | 43 × 49 | −2.1 × −0.6 | 3.50 | 1.18 | 0.85 | 72 | 90 |
| B44483 | 42 × 45 | −1.9 × −1.9 | 3.50 | 1.03 | 0.85 | 82 | 85 |
| B43468 | 37 × 38 | −1.3 × −0.5 | 3.50 | 1.32 | 1.24 | 94 | 100 |
| B44483 | 38 × 47 | −1.7 × −1.3 | 3.50 | 1.21 | 0.95 | 78 | 115 |
| B46162 | 38 × 43 | −1.0 × 0.0 | 3.50 | 1.57 | 1.40 | 89 | 130 |
| SESAME | | | | | | | |
| B42496 | 32 × 36 | −1.4 × −0.1 | 3.50 | 1.03 | 1.00 | 97 | 100 |
| B44476 | 33 × 36 | −1.1 × 0.0 | 3.50 | 1.03 | 0.95 | 92 | 80 |
| SOFT PINK | | | | | | | |
| B44625 | 39 × 47 | −1.5 × −0.5 | 3.50 | 0.72 | 0.60 | 83 | 90 |
| B46529 | 38 × 36 | −4.3 × −0.1 | 3.50 | 1.32 | 1.15 | 87 | 140 |

WRINKLE FREE FORMULATION: 200 GAL PAD/VAC

| | ADOBE<br>BUTTERCUP<br>CELERY<br>CRANBERRY<br>EVERGREEN<br>INDIGO | COOL WHITE<br>IVORY<br>SESAME | MISTY BLUE<br>SOFT PINK |
|---|---|---|---|
| GRIFFREZ 1485 | 417.0# | 417.0# | 417.0# |
| GRIFFSOFT HDP-25 | 100.1 | 100.1 | 100.1 |
| GRIFFWET 484 | 4.5 | 4.5 | 4.5 |
| GRIFFENGER WPS | 35.0 | | |
| GRIFFENGER 1431 | | 70.0 | 70.0 |
| GRIFFCAT 739 | | 8.0 | 8.0 |
| POLYCRYL 7F12 | | | 10.0 |
| GRIFFMIGRANT 1466 | | | 6.4 |
| GRIFFENGER WPS | 35.0 | | |
| GRIFFENGER 1431 | | 70.0 | 70.0 |
| GRIFFCAT 739 | | 8.0 | 8.0 |
| POLYCRYL 7F12 | | | 10.0 |
| GRIFFMIGRANT 1466 | | | 6.4 |

Although the compounds and methods of the instant invention, as well as their uses have been described with a degree of particularity, the invention herein is intended to be limited only by the claims set forth hereafter.

What is claimed:

1. A method for imparting wrinkle free properties to cotton or cotton blend fabrics comprising the steps of:

(a) selecting an all cotton or cotton blend fabric having warp and fill strengths that provides balanced finished strengths in both the warp and fill direction;

(b) contacting the cotton or cotton blend fabric with a reactant bath comprising a combination of:

(i) an amount of DMDHEU based reactant sufficient to provide a total formaldehyde content to the fabric of from about 0.7% to 1.5%, (ii) a $MgCl_2.6H_2O$ catalyst in an active amount of from about 1.0% to 15% based on the active weight of the DMDHEU based reactant, (c) heating the cotton or cotton blend fabric under conditions wherein the DMDHEU based reactant is cured to 70% to 95%.

2. A method for imparting wrinkle free properties to cotton or cotton blend fabrics according to claim 1 wherein the reactant bath also includes an oxidized high density polyethylene emulsion at a level of 0.5% to 2% solids on the weight of the DMDHEU reactant bath.

3. A method for imparting wrinkle free properties to cotton or cotton blend fabrics according to claim 1 wherein the DMDHEU reactant bath is adjusted to a pH of between about 3 to 6.

4. A method for imparting wrinkle free properties to cotton or cotton blend fabrics according to claim 1 wherein the DMDHEU based reactant is cured using at least two heat treatment steps.

5. A method for imparting wrinkle free properties to cotton or cotton blend fabrics according to claim 1 wherein the DMDHEU based reactant is the reaction product of diethylene glycol with 1,3-dihydroxymethyl-4,5-dihydroxy-2-imidazolidinone in a molar ratio of 0.5 through 2.0 of diethylene glycol to one mole of 1,3-dihydroxymethyl-4,5-dihydroxy-2-imidazolidinone.

6. A method for imparting wrinkle free properties to cotton or cotton blend fabrics according to claim 1 wherein the DMDHEU based reactant is the reaction product of methanol with 1,3-dihydroxymethyl-4,5-dihydroxy-2-imidazolidinone in a molar ratio of 0.5 through 4 of methanol to one mole of 1,3-dihydroxymethyl-4,5-dihydroxy-2-imidazolidinone.

7. The method of claim 1 in which the reactant is 1,3-dihydroxymethyl-4,5-dihydroxy-2-imidazolidinone.

8. The method of claim 1 in which the DMDHEU based reactant is the reaction product of polyethylene glycol of molecular weight 200 through 600 in a molar ratio of 0.5 through 2 to one mole of 1,3-dihydroxymethyl-4,5-dihydroxy-2-imidazolidinone.

9. The method of claim 2 wherein the cotton or cotton blend fabric is 100% cotton.

10. The method of claim 2 wherein the cotton or cotton blend fabric is a blend of polyester with 65–99% cotton.

11. The method of claim 2 wherein the cotton or cotton blend fabric contains 50%–100% cotton.

12. A wrinkle free cotton or cotton blend fabric made according to a process comprising the steps of:

(a) selecting an all cotton or cotton blend fabric having warp and fill strengths that provides balanced finished strengths in both the warp and fill direction;

(b) contacting the cotton or cotton blend fabric with a reactant bath comprising a combination of:

(i) an amount of DMDHEU based reactant sufficient to provide a total formaldehyde content to the fabric of from about 0.7% to 1.5%, (ii) a $MgCl_2.6H_2O$ catalyst in an active amount of from about 3% to about 7% based on the active weight of the DMDHEU based reactant, (c) heating the cotton or cotton blend fabric under conditions wherein the DMDHEU based reactant is cured to 70% to 95%.

13. A cotton or cotton blend fabric made according to claim 5 wherein the catalyst is present in an active amount of from about 3 to about 12 percent by weight of the reactant.

14. A cotton or cotton blend fabric made according to claim 5 wherein the catalyst is present in an active amount of from about 4 to about 10 percent by weight of the reactant.

15. A cotton or cotton blend fabric made according to claim 5 wherein the catalyst is present in an active amount of from about 5 to about 7 percent by weight of the reactant.

16. A wrinkle free cotton or cotton blend fabric made according to claim 1 wherein the fabric has a DP rating of at least 3.5, wherein the strength of the fabric is about 50% of the strength that the fabric had after bleaching, mercerization or causticization and the formaldehyde released is less than about 200 parts per million.

* * * * *